US006994385B2

(12) United States Patent
Sigears

(10) Patent No.: US 6,994,385 B2
(45) Date of Patent: Feb. 7, 2006

(54) ARROW EXTRACTOR

(76) Inventor: John M. Sigears, 8 Gaines Dr., Camden Point, MO (US) 64028

( * ) Notice: Subject to any disclaimer, the term of this patent is extended or adjusted under 35 U.S.C. 154(b) by 0 days.

(21) Appl. No.: 10/691,820

(22) Filed: Oct. 23, 2003

(65) Prior Publication Data

US 2005/0088000 A1 Apr. 28, 2005

(51) Int. Cl.
*B66C 1/42* (2006.01)

(52) U.S. Cl. ..... 294/1.1; 294/103.1; 294/102.1

(58) Field of Classification Search ..... 294/102.1, 294/103.1, 1.1, 1; 70/34; 292/32, 305, 41, 292/306

See application file for complete search history.

(56) References Cited

U.S. PATENT DOCUMENTS

| | | | | | |
|---|---|---|---|---|---|
| 249,259 | A | * | 11/1881 | Riehle | 73/859 |
| 867,036 | A | | 9/1907 | Hanford | |
| 1,933,942 | A | * | 11/1933 | Tiedemann | 219/143 |
| 3,171,178 | A | | 3/1965 | Smith et al. | |
| 3,424,038 | A | * | 1/1969 | Smith | 81/487 |
| 3,441,251 | A | | 4/1969 | Burns | |
| 3,628,221 | A | * | 12/1971 | Pasbrig | 403/18 |
| 3,776,586 | A | * | 12/1973 | Ahlgren et al. | 294/102.1 |
| 3,824,653 | A | * | 7/1974 | Sholler | 24/134 KB |
| 3,826,471 | A | | 7/1974 | Orton et al. | |
| 3,873,068 | A | | 3/1975 | Allen | |
| 4,043,020 | A | | 8/1977 | Hoggard | |
| 4,150,469 | A | | 4/1979 | Hoggard | |
| 4,273,373 | A | * | 6/1981 | van de Wetering | 294/101 |
| 5,098,236 | A | * | 3/1992 | Fischer | 410/77 |
| 5,102,100 | A | | 4/1992 | Troncoso, Jr. | |
| 5,119,529 | A | * | 6/1992 | Kaye | 24/136 R |
| 5,127,696 | A | | 7/1992 | Awano et al. | |
| 5,205,541 | A | | 4/1993 | Roberts et al. | |
| 5,445,424 | A | | 8/1995 | Binette | |
| 5,468,034 | A | | 11/1995 | Kopel | |
| 5,544,926 | A | | 8/1996 | Ravencroft | |
| 5,546,621 | A | | 8/1996 | Bulot | |
| 6,086,126 | A | * | 7/2000 | Krauss | 294/104 |
| 6,652,016 | B2 | * | 11/2003 | Sbabo et al. | 294/103.1 |
| 6,739,030 | B2 | * | 5/2004 | Miles | 29/426.5 |

* cited by examiner

*Primary Examiner*—Kathy Matecki
*Assistant Examiner*—Esther O. Okezie
(74) *Attorney, Agent, or Firm*—Chase Law Firm, L.C.

(57) ABSTRACT

An arrow extractor presents a plate having a shelf thereon for placement along one side of an embedded arrow shaft. A locking block on the opposed side of the shaft is movable from a first release position to a second locked position against the shaft so as to clamp the arrow therebetween in a friction fit therewith. Upon pulling on the handle the embedded arrow is extracted from the target. In lieu of a shelf, opposed locking blocks may be used which are slidably movable into position to clamp the arrow shaft therebetween. A handle extends from the plate and is positioned relative to the axis of the clamped arrow shaft so as to effectively transmit the pulling forces exerted on the handle to the clamped arrow shaft.

8 Claims, 1 Drawing Sheet

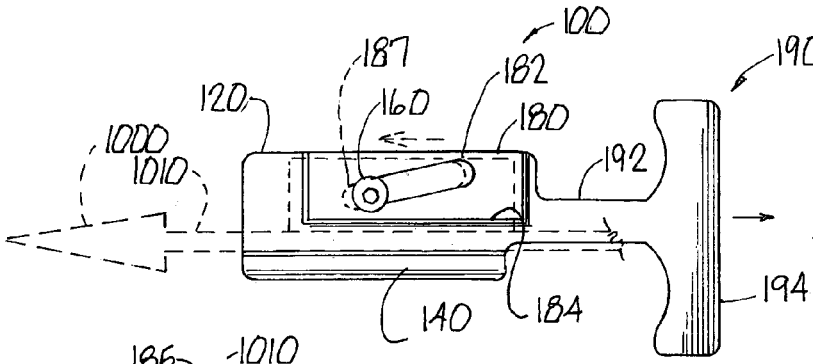
Fig. 1
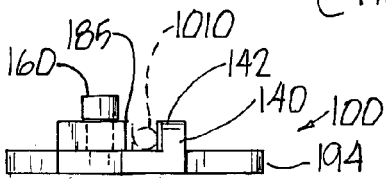
Fig. 2
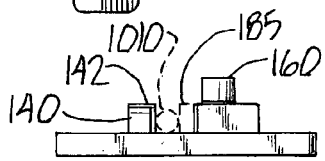
Fig. 3
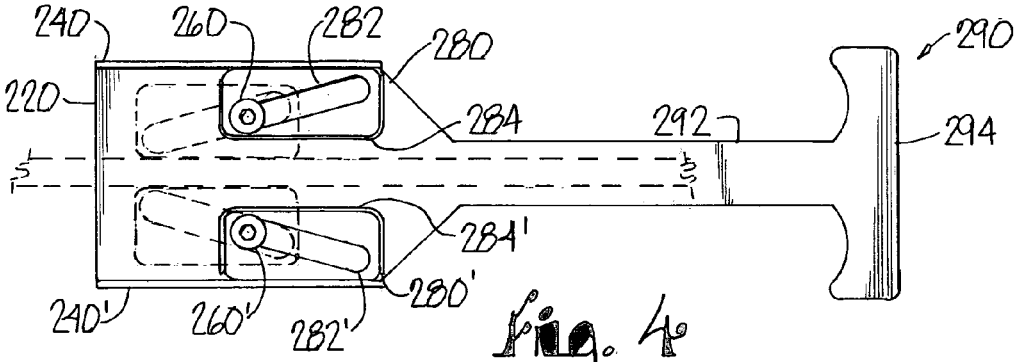
Fig. 4
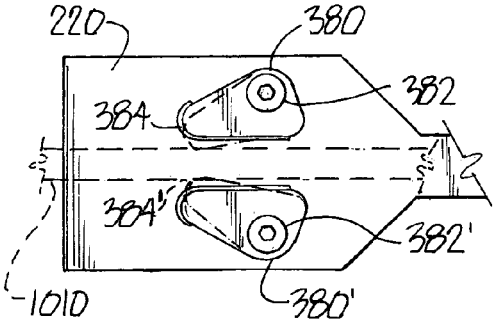
Fig. 5
Fig. 6
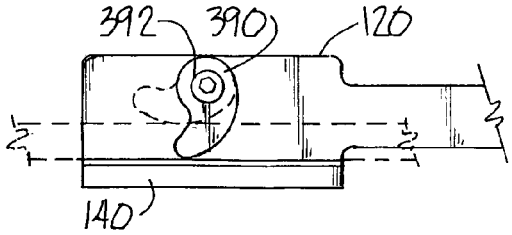

ARROW EXTRACTOR

BACKGROUND OF THE INVENTION

This invention generally relates to gripping devices and, more particularly, to a gripping device adapted for extracting an embedded arrow.

Due to the increase in arrow speed presented by improved archery bows, it has become more difficult to extract an embedded arrow from the penetrated surface. Such difficulties can arise from the depth of penetration of the arrow as well as the inability to obtain a good grip on the arrow shaft. Excessive twisting can distort, if not break, the arrow upon extraction.

In turn, various devices have been proposed for extracting an embedded arrow from the target. However, such devices may ineffectively function, are of ineffective construction and may warp, bend or break the arrow shaft upon extraction, if not properly used.

In response thereto I have devised a device which avoids the aforesaid problems and is effective for extracting the embedded arrow.

SUMMARY OF THE INVENTION

My device presents a plate which has a shelf extending therefrom, the shelf adapted to contact one side of the shaft of the embedded arrow. Spaced from the shelf is a locking block having a free edge movable between a first release position and a second clamping position, the latter position sufficiently clamping the arrow shaft against the shelf. A slot/post combination associated with the locking block allows the user to slide the locking block between these positions. Extending from the plate and generally in line with the axis of the clamped arrow shaft is a handle which is pulled by the user so as to extract the arrow from the surface. The position of the handle, relative to the central axis of the clamped arrow shaft, effectively transfers the pulling forces on the handle to the embedded arrow and diminishes twisting, bending or the like. Upon arrow extraction the locking block is user movable to its first release position so as to release the extracted arrow.

Alternative devices are shown which use a plurality of locking blocks with the arrow embedded therebetween or different configurations of the locking block.

It is therefore a general object of this invention to provide an arrow extractor.

Another object of this invention is to provide an arrow extractor, as aforesaid, which includes a locking element thereon movable between a first position displaced from an arrow shaft and a second position clamping the arrow shaft.

A further object of this invention is to provide an arrow extractor, as aforesaid, presenting a shelf for bearing against a portion of the arrow shaft.

Another object of this invention is to provide an arrow extractor, as aforesaid, wherein the locking element may be of various configurations.

Another object of this invention is to provide an arrow extractor, as aforesaid, wherein the number and/or configuration of the locking elements can be changed.

A further object of this invention is to provide an arrow extractor, as aforesaid, presenting a handle for effectively transferring user forces thereon to the longitudinal axis of the arrow shaft.

Other objects and advantages of this invention will become apparent from the following description taken in connection with the accompanying drawings, wherein is set forth by way of illustration and example, a now preferred embodiment of this invention.

BRIEF DESCRIPTION OF THE DRAWINGS

FIG. 1 is a side view of the extractor showing in solid lines the locking block in a release position and a clamping position in phantom lines with the arrow also being shown in phantom lines.

FIG. 2 is a left end view of the FIG. 1 device with a portion of the clamped arrow shaft being shown in phantom lines.

FIG. 3 is a right end view of the FIG. 1 device with a portion of the clamped arrow shaft being shown in phantom lines.

FIG. 4 is a side view of an alternative embodiment showing the use of two locking blocks in a solid line release position and a phantom line clamping position.

FIG. 5 is a side fragmentary view of the FIG. 4 device showing alternatively configured, cam-like locking blocks.

FIG. 6 is a side fragmentary view of the FIG. 1 device showing an alternatively configured, cam-like locking block.

DESCRIPTION OF THE PREFERRED EMBODIMENT

Turning more particularly to the drawings, FIGS. 1–3 shows a first embodiment 100 of my invention. As shown, the device 100 comprises a generally rectangular plate 120 having a shelf 140 extending from one edge thereof. A post 160 extends from the plate 120 and through diagonal slot 182 in a generally rectangular locking block 180. Thus, the locking block 180 is movable from a first position displaced from the shelf 140 (FIG. 1 solid lines) to a second position approaching the shelf (FIG. 1, phantom lines). At this second position, the lateral distance between a free edge 184 of block 180 and shelf 140 is diminished as the free edge 184 of block 180 longitudinally approaches the arrow head 1000. Along the free edge 184 of the locking block 180 and shelf 140 are cushioning strips 142, 185 such as rubber or the like.

Extending from the plate 180 is a handle 190 comprising a first neck/shank 192 and a second finger grip 194 about which the fingers are wrapped for pulling.

In use, upon embedding the arrow head 1000 in the target, the extractor 100 is positioned such that one side of the arrow shaft 1010 bears against the shelf 140. The locking block 180 is then slidable from its first release position to its second clamping position. During this movement the path of the block 180 is guided by the post 164/diagonal slot 182 combination such that the free edge 184 of the locking block 180 approaches the shelf 140 while longitudinally moving relative thereto and towards head 1000. Edge 184 first contacts the opposed side of the arrow shaft 1010 opposite shelf 140. Subsequent movement of block 180 further urges the free edge 184 toward the arrow head 1000 and towards the shelf 140 so as to clamp the arrow shaft 1010 against the shelf 140. The friction fit of edge 184 against shaft 1010 precludes rearward movement of block 180 which locks the block 180 in its clamping position against shaft 1010.

At this position the handle 190 is then grasped with the fingers encircling the grip 194. Upon a user pulling on handle 190 the straight line forces are transmitted along the neck 192 and to the imaginary central axis of the arrow shaft 1010. It is understood that the central axis of shank 192 may be slightly parallel to the axis of shaft 1010 or may be constructed so as to be collinear therewith. Thus, forces are effectively transferred from the handle 190 to the arrow shaft 1010 allowing for straight line extraction of the arrow from the target without twisting, bending and/or breakage of shaft 1010. Subsequently, the locking block 180 is then moved from its clamping to its release position (FIG. 1 solid line) allowing for the arrow to be removed. Although the block 180 has been shown to be manually slidable between its release and clamping positions, it is understood that a spring 187 may be located within slot 182 so as to bias the block 180 to its second clamping position. Thus, the user overcomes such bias by compressing the spring 187 to move block 180 to its release position.

As can be appreciated, the longitudinal extension of the shelf 140 and the longitudinal extension of the free edge 184 of locking block 180 along the arrow shaft on opposed sides thereof transmits the pulling forces along an extended length of the arrow 1010. Thus, the forces are not concentrated in a specific area of the arrow shaft which also diminishes the possibility of the shaft twisting, warping or breaking.

FIG. 4 illustrates an alternative embodiment 200 of my invention in which two opposed locking blocks 280, 280' are shown. As such the locking blocks 280, 280' are slidably mounted about posts 260, 260' which extend from plate 220 and through diagonal slots 282, 282'. Upon penetration of the arrow into the target, the blocks 280, 280' are placed on both sides of shaft 1010 with blocks being in their release position (FIG. 4, solid lines). Shelves 240, 240' restrict movement of blocks 280, 280' beyond plate 220. As above, the locking blocks 280, 280' are user movable towards the arrow shaft 1010 and head 1000 which diminish the vertical distance between the locking blocks 280, 280' and urges the free edges 284, 284' of each plate 280, 280' into engagement with the opposed sides of arrow shaft 1010. Upon further movement the blocks 280, 280' are precluded from further movement due to the friction fit engagement with shaft 1010 clamped therebetween (FIG. 4, phantom lines). Upon pulling on the grip 294 of handle 290 the forces are transmitted along the neck/shank 292 and along the imaginary central axis of the arrow shaft which is collinear with the central axis of shank 292. It is understood that either one or both of the locking blocks 280, 280' may be moved so as to ultimately clamp the arrow shaft 1010 therebetween. Thus, the locking blocks 280, 282 may clamp the arrow 1010 at different lengths along the arrow shaft 1010 which further diminishes the possibility of warpage, twisting, pinching and breaking upon pulling on the handle 290.

FIG. 5 shows an alternative embodiment of locking blocks in the form of opposed cam-like, lobed locking elements 380, 380' which are spring biased about pins 382, 382' so that lobes 384, 384' normally bear against the arrow shaft 1010 placed therebetween as shown in phantom lines. FIG. 6 shows an example of a cam-like locking block 390 which is also spring biased about pin 392 to normally bear against one side of the arrow shaft 1010 with the opposed side bearing against shelf 140 as described in the FIG. 1 embodiment.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent:

1. A device for extracting an arrow from a surface, the arrow including a head and shaft, said device comprising:

a plate;

a post extending from said plate;

a shelf extending from said plate, said shelf presenting a longitudinally extending flat surface adapted to bear along a longitudinal portion of an arrow shaft positioned thereon;

a block slidably mounted to said plate in a path having a first and second position(s), said block presenting a longitudinally extending flat surface parallel to said shelf, said block surface adapted to bear along a longitudinal portion of the arrow shaft at said second position opposite said parallel shelf surface, said block surface at said first position being displaced from said shelf surface and the arrow shaft thereon and at said second position is laterally and longitudinally displaced relative to said shelf surface to present a locked bearing relationship against the arrow shaft on said shelf, the arrow shaft clamped at a plurality of points there along by said block flat surface and said parallel shelf flat surface at said second position;

a slot in said block for extension of said post therein, said block slidable along said post to define said path of said block between said first and second positions;

a handle extending from said plate, said handle adapted for grasping by a user and positioned whereupon a pulling by a user on said handle directs a force along a length of the clamped arrow shaft for extraction from the embedded surface;

said block being slidable to said first position to release the clamped arrow.

2. The device as claimed in claim 1 wherein said handle includes an imaginary axis generally positioned relative to a central, longitudinal axis of the clamped arrow shaft, wherein said pulling said handle is generally directed along said axis of the clamped arrow shaft.

3. The device as claimed in claim 1 wherein said slot is in a generally acute angular position relative to said shelf, whereby said path of said block between said first and second positions relative to said shelf is in a generally longitudinal displacement and a diminishing lateral displacements relative to said shelf whereby to provide said clamping of the arrow shaft between said block and said shelf at said second position.

4. The device as claimed in claim 1 wherein said block path provides a friction fit engagement of said block flat surface with the arrow shaft at said second position to provide said locked bearing relationship and preclude movement of said block towards said first position.

5. A device for extracting an arrow from a surface, the arrow including a head and shaft, said device comprising:

a plate;

a post extending from said plate;

a first clamping surface mounted to said plate, said first clamping surface presenting a longitudinally extending flat surface adapted to bear along a length of the arrow shaft;

a second flat longitudinally extending clamping surface mounted to said plate and parallel to said first clamping surface, said second clamping surface presenting a longitudinally extending flat surface and adapted to bear along a length of the arrow shaft opposite said first clamping surface in a parallel relationship thereto, at least one of said surfaces having a first position displaced from the other clamping surface for placement of an arrow shaft therebetween and a second position urging said at least one clamping surface towards the other clamping surface and towards an end of the arrow shaft, the arrow shaft at said second position clamped by said flat surfaces at a plurality of points between said first clamping surface and said second clamping surface at said second position, at least said one of said clamping surfaces at said second position in a friction fit with the arrow shaft, a slot in at least one of said clamping surfaces for reception of said post therein, said at least one said slot slidable along said post to define said path of said at least one clamping surface between said first and second positions, whereby to lock at least said one of said clamping surfaces at said second position against the arrow shelf, a pulling force on said plate transmitted to the clamped arrow for extraction from a penetrated surface.

6. The device as claimed in claim 5 further comprising a handle extending from said plate, wherein a pulling force on said handle directs a similar pulling force on said plate and along the clamped arrow shaft.

7. The device as claimed in claim 6 wherein said handle extends from said plate at a position whereby a straight line pulling force on said handle is directed in a generally similar straight line motion along the clamped arrow shaft.

8. The device as claimed in claim 5 wherein said at least one slot of said at least one clamping surface is in a generally acute angular position relative to said other clamping surface, whereby said path of said at least one clamping surface between said first and second positions is in generally longitudinal and lateral displacements relative to said other clamping surface and the arrow shaft therebetween.

* * * * *